US011517067B1

(12) United States Patent
Almodovar

(10) Patent No.: US 11,517,067 B1
(45) Date of Patent: Dec. 6, 2022

(54) HELMET COOLING SYSTEM

(71) Applicant: Harry Almodovar, Winter Park, FL (US)

(72) Inventor: Harry Almodovar, Winter Park, FL (US)

( * ) Notice: Subject to any disclaimer, the term of this patent is extended or adjusted under 35 U.S.C. 154(b) by 0 days.

(21) Appl. No.: 17/746,688

(22) Filed: May 17, 2022

(51) Int. Cl.
*A42B 3/28* (2006.01)
*F25D 17/06* (2006.01)
*F25D 3/08* (2006.01)

(52) U.S. Cl.
CPC ..... *A42B 3/286* (2013.01); *F25D 3/08* (2013.01); *F25D 17/067* (2013.01); *F25D 2317/068* (2013.01); *F25D 2400/26* (2013.01)

(58) Field of Classification Search
CPC ..... A42B 3/286; A42B 3/285; F25D 2400/26; F25D 3/08; F25D 17/067; F25D 2317/068
See application file for complete search history.

(56) References Cited

U.S. PATENT DOCUMENTS

| | | | | |
|---|---|---|---|---|
| 1,029,952 | A | 6/1912 | Smith | |
| 3,140,590 | A | 7/1964 | Gleockler | |
| 3,223,086 | A | 12/1965 | Denton | |
| 4,100,320 | A | 7/1978 | Chisum | |
| 4,172,495 | A | 10/1979 | Zebuhr et al. | |
| 5,146,757 | A | 9/1992 | Dearing | |
| 5,948,012 | A | 9/1999 | Mahaffey et al. | |
| 6,715,309 | B1 | 4/2004 | Junkins | |
| 6,942,015 | B1 | 9/2005 | Jenkins | |
| 7,373,969 | B2 | 5/2008 | Chambers | |
| 2010/0032132 | A1 | 2/2010 | Collins | |
| 2010/0154454 | A1 | 6/2010 | Blackstone | |
| 2010/0236267 | A1* | 9/2010 | Korytnikov | F24F 5/0035 62/426 |
| 2016/0206018 | A1 | 7/2016 | Barbret | |
| 2017/0370600 | A1* | 12/2017 | Duncan | A45C 13/00 |
| 2018/0103711 | A1* | 4/2018 | Abrahamson | A42B 3/125 |

(Continued)

FOREIGN PATENT DOCUMENTS

| | | |
|---|---|---|
| CN | 106805345 | 5/2019 |
| GB | 2475922 | 6/2011 |
| JP | 6589268 | 10/2020 |

(Continued)

OTHER PUBLICATIONS

Polar Products, Inc., "Buy Polar Cool Flow Head Cap System", https://www.rehab-store.com/p-polar-active-ice-head-cap-cold-therapy-system.html?, downloaded on Nov. 11, 2021, pp. 1-4.

(Continued)

*Primary Examiner* — Cassey D Bauer
(74) *Attorney, Agent, or Firm* — The Concept Law Group, PA; Scott D. Smiley; Scott M. Garrett

(57) ABSTRACT

A helmet cooling system includes a reservoir for holding a chilled medium and includes fan that that draws ambient air into the reservoir so that the air will pass over the chilled medium and exit the reservoir through a tube that is connected to a helmet. The helmet includes several channels for distributing the chilled air to the wearer's head to help keep the wearer comfortable. The reservoir can include a diverter valve to preserve the chilled medium when it is not necessary by sealing off the chilled medium and preventing air from circulating past it or otherwise contacting the chilled medium.

13 Claims, 19 Drawing Sheets

(56) References Cited

U.S. PATENT DOCUMENTS

2021/0106459 A1 4/2021 Caruso et al.

FOREIGN PATENT DOCUMENTS

| | | |
|---|---|---|
| JP | 6782053 | 11/2020 |
| WO | 2018007861 | 1/2018 |

OTHER PUBLICATIONS

Eldho, Alias Sonnet T., et al. "Design and analysis of a smart-attachment to jacket and helmet used by two-wheeler riders using Peltier-module." Materials Today: Proceedings 42 (2021): 862-869.
Remeli, Muhammad Fairuz, et al. "Experimental study of a mini cooler by using Peltier thermoelectric cell." IOP Conference Series: Materials Science and Engineering. vol. 788. No. 1. IOP Publishing, 2020.
Diandra, "How NASCAR Keep Cool: Building Speed",Sep. 11, 2020, https://buildingspeed.org/2020/09/11/cool-nascar-drivers/, downloaded on Nov. 15, 2021, pp. 1-11.
Cao, Linlin, et al. "Design and experiment study of a new thermoelectric cooling Helmet." Procedia Engineering 205 (2017): 1426-1432.

* cited by examiner

HELMET COOLING SYSTEM

FIELD OF THE INVENTION

The present invention relates generally to helmet cooling systems, and, more particularly, relates to a portable helmet cooling system that is particularly useful for motorcycle helmets and motorcycle recreation.

BACKGROUND OF THE INVENTION

Many people enjoy motorcycle recreation, including off-road and road riding. Given the nature of motorcycles and the stability issues they have as a result of only having two points of contact with the ground, they tend to be warm weather vehicles, meaning people tend to ride them mostly, if not exclusively when roads aren't likely to have ice on them. More specifically, they are popular in warm weather. As a result, it is not uncommon for a motorcycle rider to feel uncomfortably warm, particular in lower latitudes. The ambient heat can be especially uncomfortable on a rider's head due to wearing a helmet, which prevents strong air circulation.

Therefore, a need exists to overcome the problems with the prior art as discussed above.

SUMMARY OF THE INVENTION

In accordance with some embodiments of the inventive disclosure, there is provided a motorcycle helmet cooling system that includes a portable reservoir, a helmet, and a connecting tube. The portable reservoir includes an interior compartment defining an interior volume and it has a floor and a surrounding interior wall around, and extending upward from, the floor to an opening. There is further includes a fan adjacent a fan opening, and a connecting feature extending from an exterior of the portable reservoir. The connecting feature includes a bore therethrough that is fluidly connected to the interior compartment. The fan is configured to draw air into the interior compartment and push the air in the interior compartment out through the bore of the connecting feature. The interior compartment has a lower portion proximate to the floor that is configured to hold a chilled medium. The helmet has an interior liner having a channel formed in the liner, and further has a connecting feature on an exterior of the helmet having a bore therethrough that is fluidly connected to the channel in the liner. The connecting tube has a first end coupled to the connecting feature of the portable reservoir and a second end coupled to the connecting feature of the helmet. Accordingly, air can be drawn into the reservoir by the fan where it can be chilled by the chilled medium before exiting the reservoir through the connecting tube to be blown over the wearer's head.

In accordance with a further feature, the portable reservoir includes a fan speed selector switch hat is configured to control a speed of the fan.

In accordance with a further feature, a rechargeable battery is coupled to the fan and provides power to the fan, and a charging port on the portable reservoir is operably coupled to the rechargeable battery.

In accordance with a further feature, the system further includes a diverter valve disposed inside the reservoir that is configured to be moved between a first position and a second position. In the first position the diverter valve closes off the lower portion of the interior compartment, and in the second position forces airflow from the fan to pass under a portion of the diverter valve adjacent the lower portion of the interior compartment.

In accordance with a further feature, the diverter valve is mounted on an axis that passes through the interior compartment of the portable reservoir and extends through a sidewall of the reservoir to a valve control knob on the exterior of the portable reservoir.

In accordance with a further feature, the system further includes a median wall disposed in the internal compartment of the portable reservoir that extends from a top of the internal compartment, and which has a lower edge that is shaped in correspondence with an outer edge of the diverter valve.

In accordance with some embodiments of the inventive disclosure, there is provided a motor cycle helmet cooling system that includes a portable reservoir unit having an upper portion and a lower portion, the upper portion and the lower portion each being configured to assemble together and define an interior compartment within the upper and lower portions when assembled together. The portable reservoir including a fan adjacent a fan opening through a wall of the portable reservoir, and a connecting feature extending from an exterior of the portable reservoir and having a bore therethrough that is fluidly connected to the interior compartment. The fan is configured to draw air into the interior compartment and out through the bore of the connecting feature, and the interior compartment has a lower portion that is configured to hold a chilled medium. The portable reservoir further includes a diverter valve mounted in the interior compartment that is movable between a first position and second position, wherein in the first position the diverter valve closes off the lower portion of the interior compartment and provides a barrier between the lower portion of the interior compartment and the fan, and wherein in the second position the diverter valve forces air from the fan to pass under the diverter valve adjacent the lower portion of the interior compartment before exiting through the connecting feature. The system further includes a helmet having an interior liner comprising a channel formed in the liner and a connecting feature on an exterior of the helmet having a bore therethrough that is fluidly connected to the channel in the liner. The system further includes a connecting tube having a first end coupled to the connecting feature of the portable reservoir and a second end coupled to the connecting feature of the helmet.

In accordance with a further feature, the system further includes the diverter valve having a planar member having a transverse axis that extends horizontally from one side of the portable reservoir through the internal compartment to an opposite side of the portable reservoir. The planar member having a first portion that extends from the axis to an outer edge. When the diverter valve is in the first position, the outer edge of the first portion is adjacent an inner wall of the portable reservoir, and rests against a stop feature on the inner wall. The system further includes a median wall that extend down from a top of the interior compartment, and which has a lower edge that is shaped in correspondence with the outer edge of the first portion of the diverter valve. The system further includes a shelf that extends horizontally into the interior compartment to meet an outer edge of a second portion of the diverter valve that is opposite the first portion of the diverter valve relative to the axis, and wherein the second portion of the diverter valve extends a shorter distance from the axis than the first portion of the diverter valve extends from the axis.

In accordance with a further feature, the system further includes a diverter valve control on an outside of the portable reservoir along the axis.

In accordance with a further feature, the portable reservoir includes a fan speed selector switch hat is configured to control a speed of the fan.

In accordance with a further feature, the system further includes a rechargeable battery coupled to the fan which provides power to the fan, and a charging port on the portable reservoir that is operably coupled to the rechargeable battery.

In accordance with a further feature, a lower edge of the upper portion of the portable reservoir is threaded, and a top edge of the lower portion of the portable reservoir is correspondingly threaded to engage the threads of the upper portion of the portable reservoir, thereby allowing the upper portion and the lower portion to be assembled together.

In accordance with a further feature, the upper portion and the lower portion of the portable reservoir are joined together by a hinge.

In accordance with a further feature, a latch is disposed on the portable reservoir opposite the hinge that is configured to releasably latch the upper and lower portions of the portable reservoir together.

Although the invention is illustrated and described herein as embodied in a helmet cooling system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the element being referenced. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
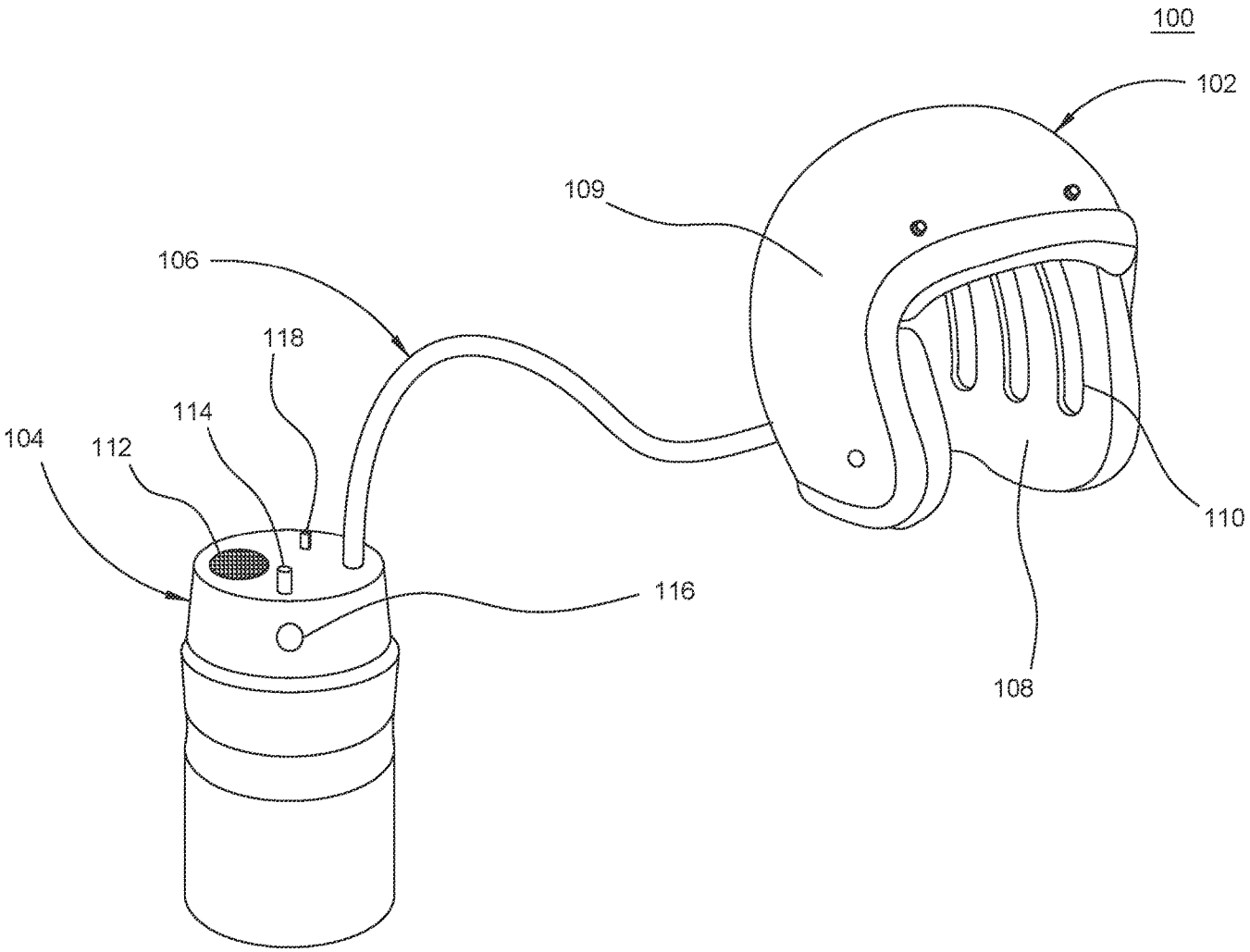
FIG. 1 is a perspective view of a helmet cooling system including a helmet, a reservoir, and a connecting tube, in accordance with some embodiments

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is a perspective view of a helmet cooling system 100 including a helmet 102, a reservoir 104, and a connecting tube 106, in accordance with some embodiments. In general, the reservoir 104 has walls that are thermally insulated and a volume inside the reservoir 104. The reservoir 104 includes a fan that draws outside air into the reservoir 104 through a fan port 112. Inside the reservoir 104 there can be placed a mass of chilled material so that air drawn into the reservoir 104 is chilled from contact with the chilled material. The pressure created by the fan forces the chilled air through the connecting tube 106 that is connected at one end to the reservoir 104 and at its other end to a similar connecting feature on the helmet 102. The connecting feature on the helmet 102 allows air to pass through the exterior 109 of the helmet into distribution channels 110 in the liner 108 of the helmet 102 that distribute the chilled air to the wearer's head to help keep the wearer cool. The reservoir 104 can include a fan speed control 114, a charging port 118, and a diverter valve control 116, as will be described in further detail herein. Further, the reservoir 104 can be opened to access the interior volume to add the chilled material into the reservoir 104. For example, the reservoir 104 can include a top portion and a bottom portion that join together and can separate from each other.

Figure 2:
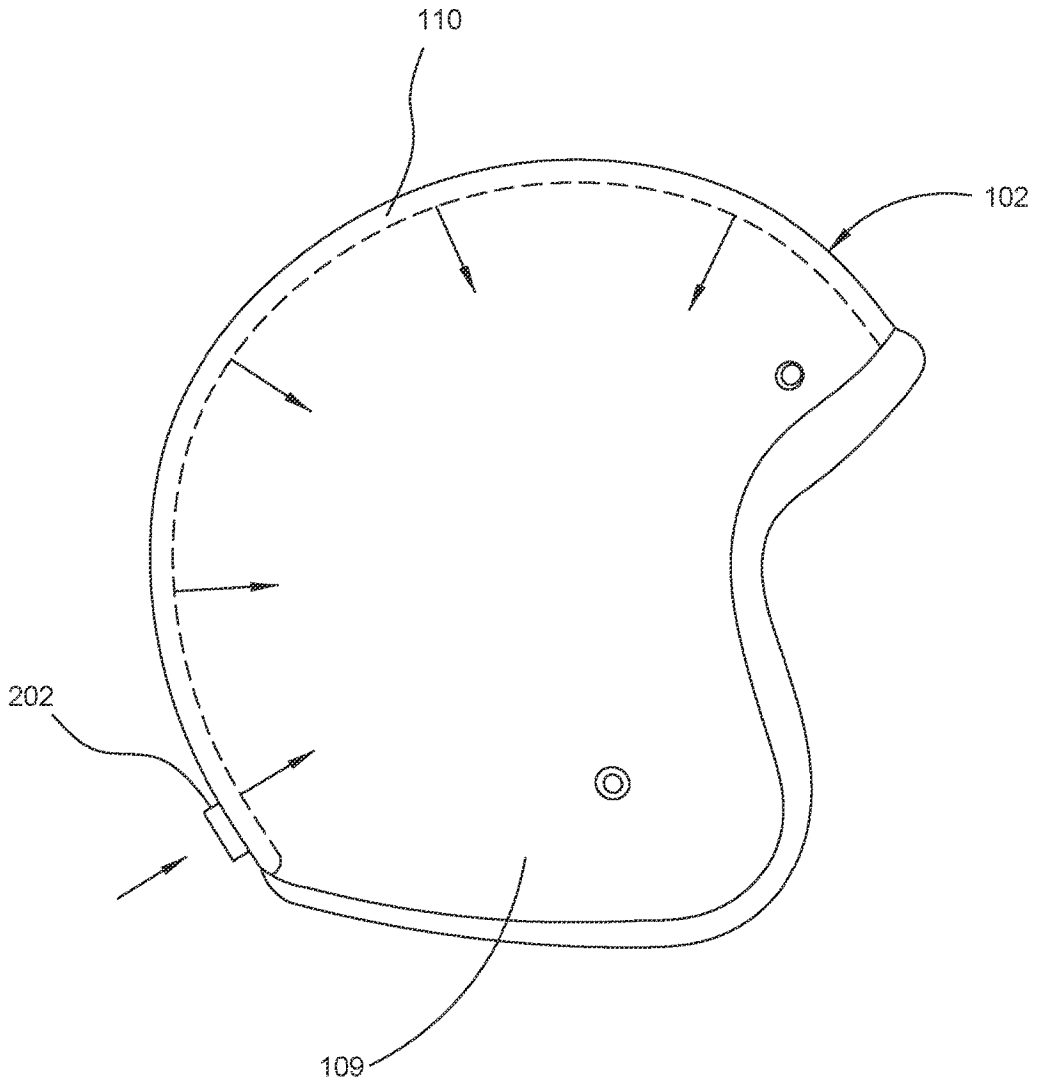
FIG. 2 is a side view of a helmet for use in a helmet cooling system in which air channels are formed in the liner of the helmet for distributing air from the reservoir, in accordance with some embodiments.
Figure 3:
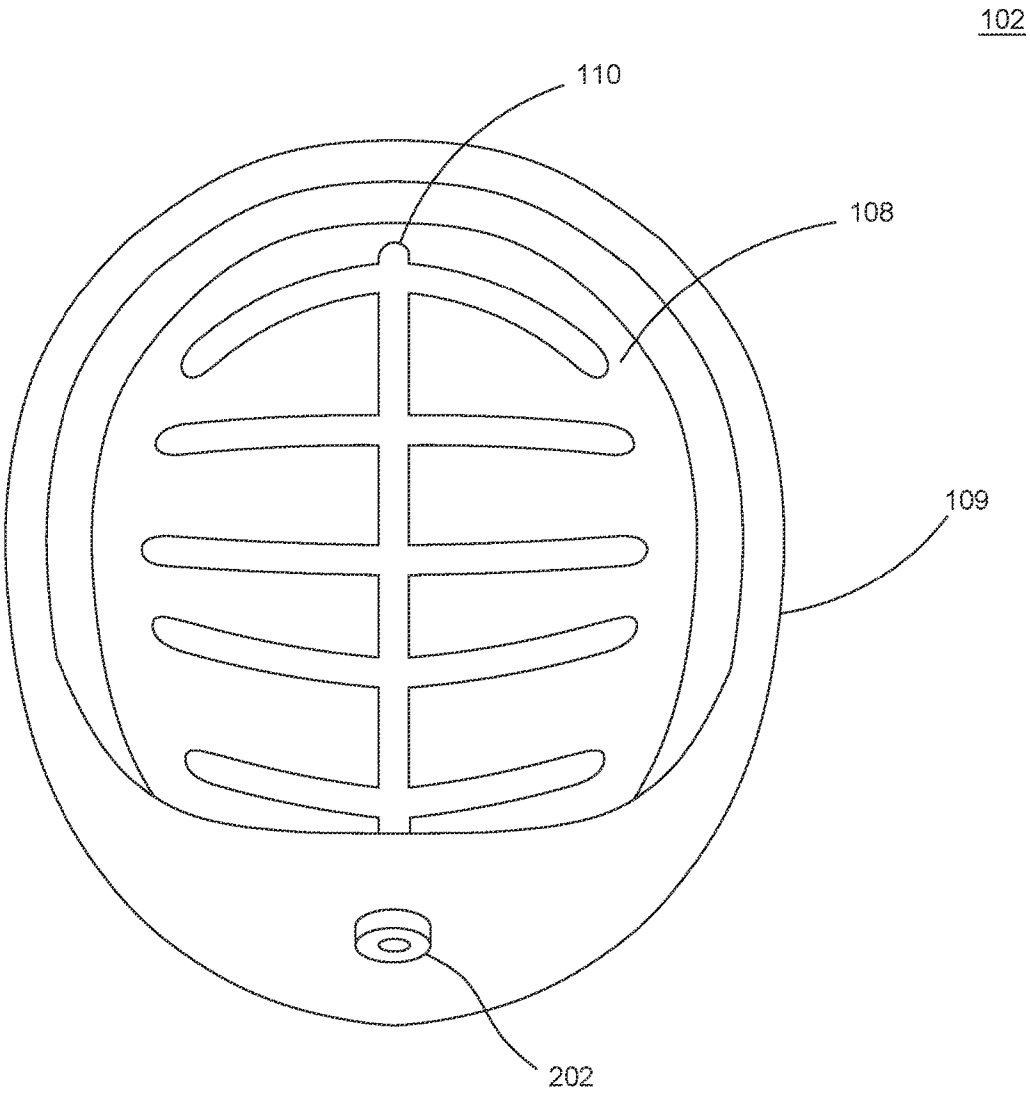
FIG. 3 is a bottom view of a helmet for use in a helmet cooling system showing air channels formed in the liner of the helmet for distributing air from the reservoir, in accordance with some embodiments.

FIG. 2 is a side view of a helmet 102 for use in a helmet cooling system in which air channels 110 are formed in the liner of the helmet for distributing air from the reservoir, in accordance with some embodiments. The helmet 102 has a connecting feature 202 that allows the connecting tube 106 to connect to the helmet 102. The connecting feature 202 can be any known tube or hose connecting structure, including a threaded extension or collar, a press fit boss, a locking post and channel configuration, and so on. The connecting feature 202 passes through the exterior shell 109 of the helmet, and includes a channel through it that communicates with the distribution channels 110 in the helmet liner (108). FIG. 3 is a bottom view of a helmet 102 showing air channels 110 formed in the liner 108 of the helmet for distributing air from the reservoir provided by the connecting tube through the connecting feature 202. Other than connecting feature 202 and the channels 110 the helmet 102 can be a conventional helmet.

Figure 4:
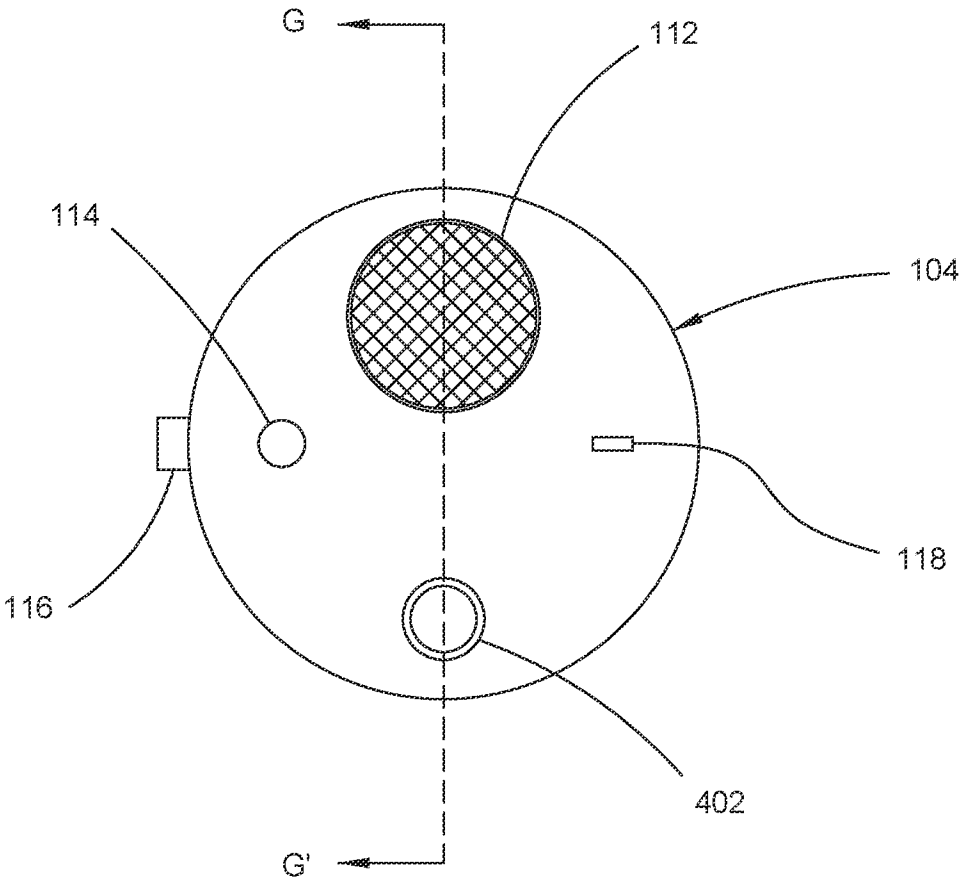
FIG. 4 shows a top view of a reservoir for use with a helmet cooling system, in accordance with some embodiments.

FIG. 4 shows a top view of a reservoir 104 for use with a helmet cooling system, in accordance with some embodiments. In this example the top of the reservoir 104 includes a fan port 112 through which air is drawn into an interior volume of the reservoir 104 by a fan disposed inside the reservoir 104. The fan is powered by a battery which can be a rechargeable battery that can be recharged through a recharging port 118, such as a micro-USB port or any suitable equivalent configuration for the purpose of battery charging. A fan speed control knob 114 allows a user to adjust the speed of the fan and thereby the amount of air delivered to the helmet 102. A connecting feature 402 is configured to interface with one (or both) end of the connecting tube 106 so that air from the interior volume of the reservoir 104 can pass into the connecting tube 106 and thereby into the helmet 102. A diverter valve control 116 extends from a side of the reservoir and allows the user to adjust the position of a diverter valve disposed inside the reservoir 104. Plane G-G' is shown by a broken line and indicates a section plane of view for subsequent drawings, and the arrows at G and G' indicate the direction of the viewer in such views.

Figure 5:
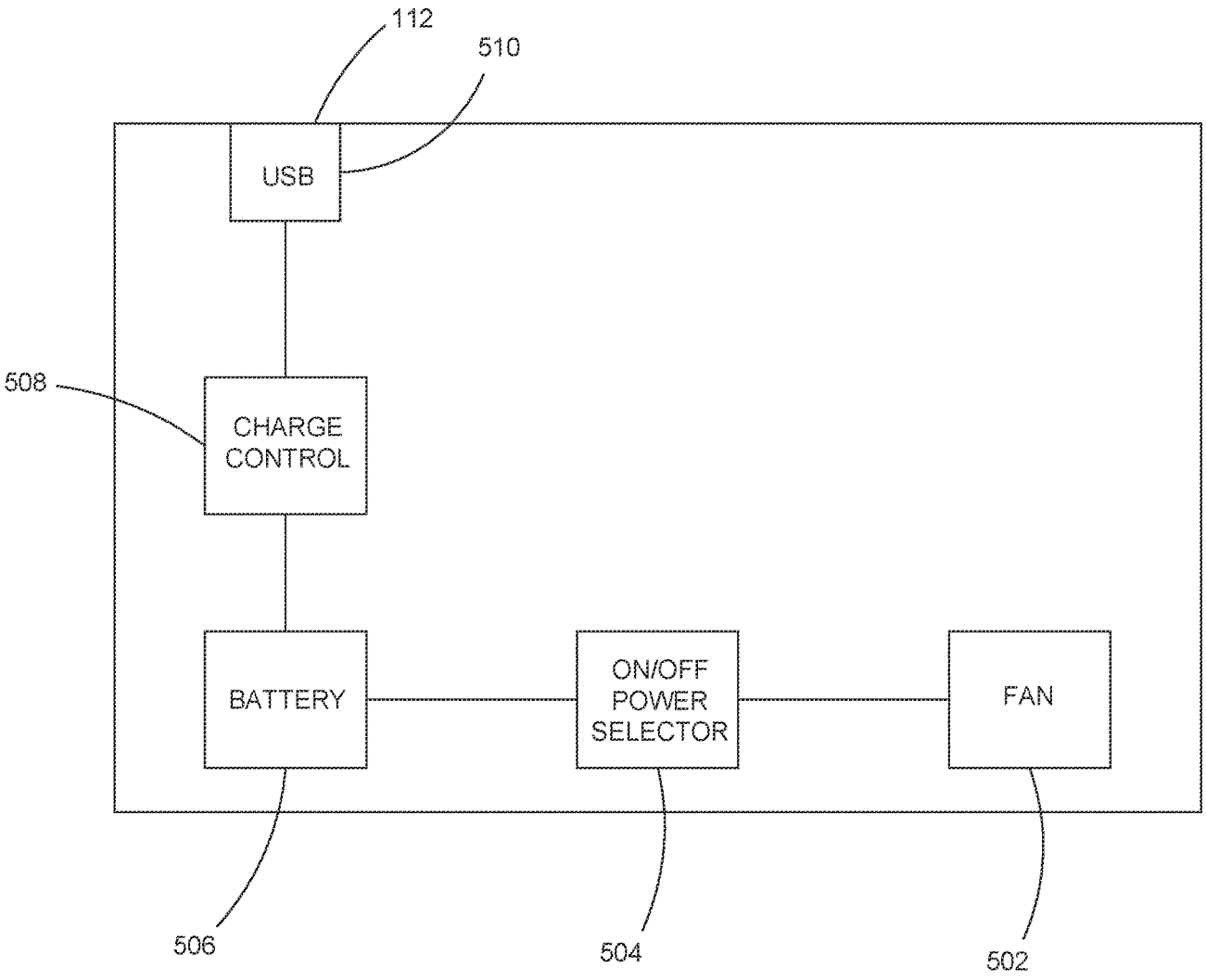
FIG. 5 is an electrical schematic of a fan system of a reservoir for use in a helmet cooling system, in accordance with some embodiments.

FIG. 5 is an electrical schematic of a fan system of a reservoir for use in a helmet cooling system, in accordance with some embodiments. The fan system includes a fan 502 that is disposed in or on the reservoir. The fan 502 draws air into the interior volume of the reservoir so that the air may come into contact with the chilled material, and then exit the reservoir through the connecting tube and be distributed to the channels in the helmet liner. The power to operate the fan 502 is provided by a battery 506 through an on/off selector 504. The selector 504 can adjust the amount of power, as well as on/off operation, to the fan to control fan speed. The battery 506 can be a rechargeable battery that is recharged by a charge control circuit 508, which receives power through a connector 510 that can provide a USB interface 112.

Figure 6:
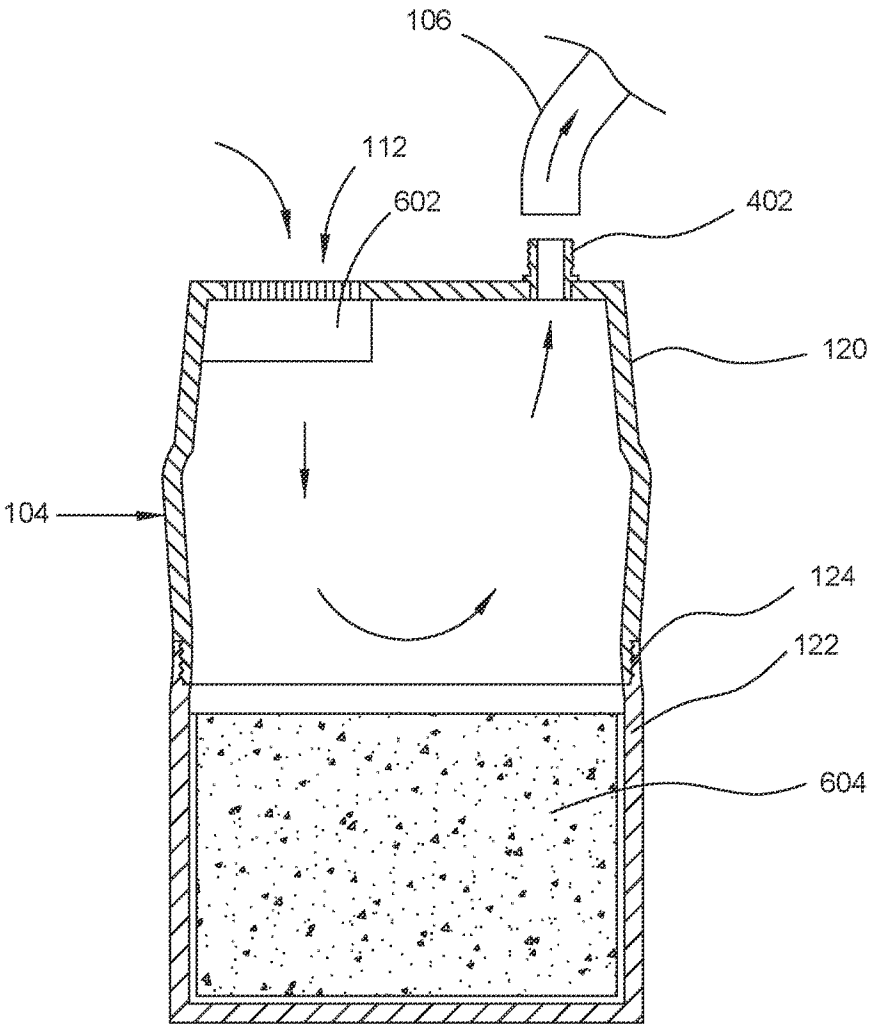
FIG. 6 is a side sectional view of a reservoir taken along plane G-G', in accordance with some embodiments.

FIG. 6 is a side sectional view of a reservoir 104 taken along plane G-G', in accordance with some embodiments. A fan 602, which can be the same or equivalent to fan 502 of FIG. 5, is located proximate the fan port 112 inside the reservoir 104. A chilled material 604 is also disposed in the interior volume of the reservoir 104. The chilled material can be ice, or a product that houses material known to have thermal properties similar to water/ice that can be removed from the reservoir 104 and placed into a freezer, and thereby reused. Air is moved by the fan 602 in the direction of the arrows; air is drawn in from the outside into the interior volume of the reservoir, where at least some of the air will make contact with the chilled material and itself become cooled relative to the ambient temperature outside of the reservoir 104. The air is then moved out of the reservoir through the connecting feature 402 into the connecting tube 106 and then to the helmet. The reservoir can be formed of an upper portion 120 and a lower portion 124 that are joined together by a threaded interface 124 that extends around the reservoir. That is, the two portions 120, 122 can be unscrewed from each other to open the reservoir. Alternatively, the top of the reservoir 104, including the fan 602, fan port 112, connecting feature 402, and other components can be housed in a lid that fits on the top of the reservoir 104. Alternate means of opening/closing the reservoir 104 can be used equivalently, including providing a hinge at one side that joins the upper and lower portions 120, 122 with a latch on the opposite side from the hinge.

Figure 7:
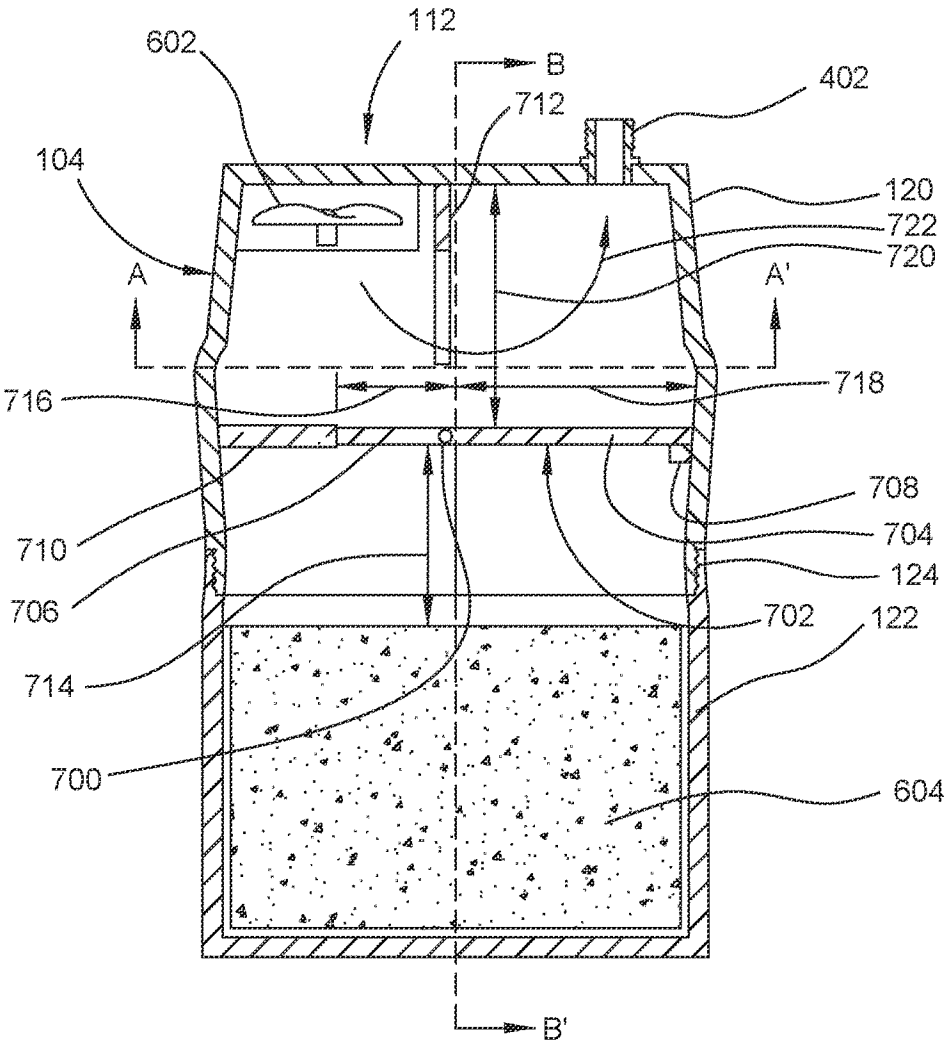
FIG. 7 is a side sectional view of a reservoir taken along plane G-G' having a diverter valve, in accordance with some embodiments.
Figure 8:
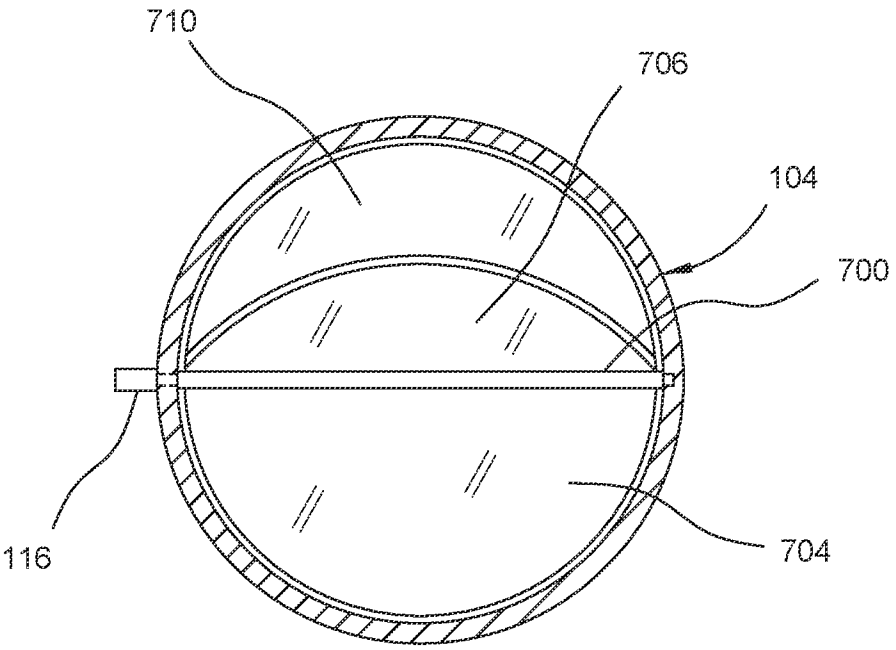
FIG. 8 is a top cross section view of a reservoir taken along plane A-A' showing the diverter valve in a first position, in accordance with some embodiments.
Figure 9:
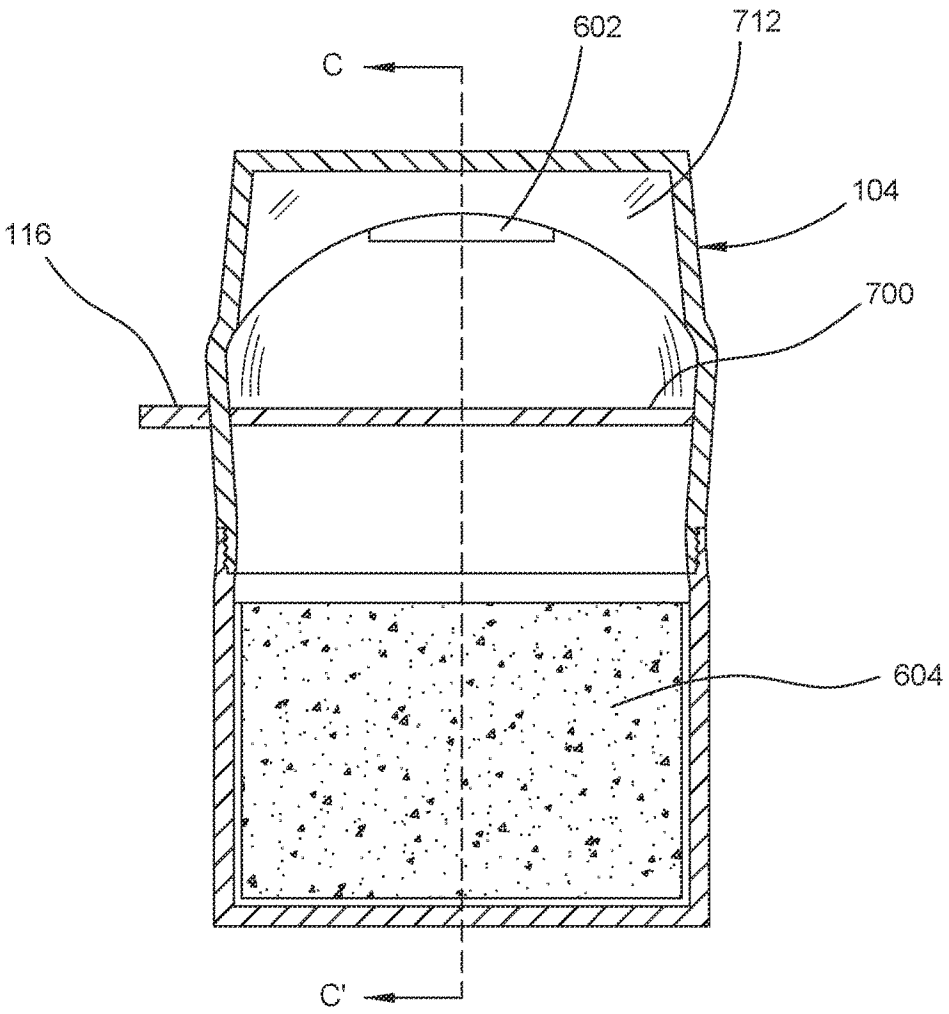
FIG. 9 is a front cross section view of a reservoir taken along plane B-B' showing the diverter valve in a first position, in accordance with some embodiments.
Figure 10:
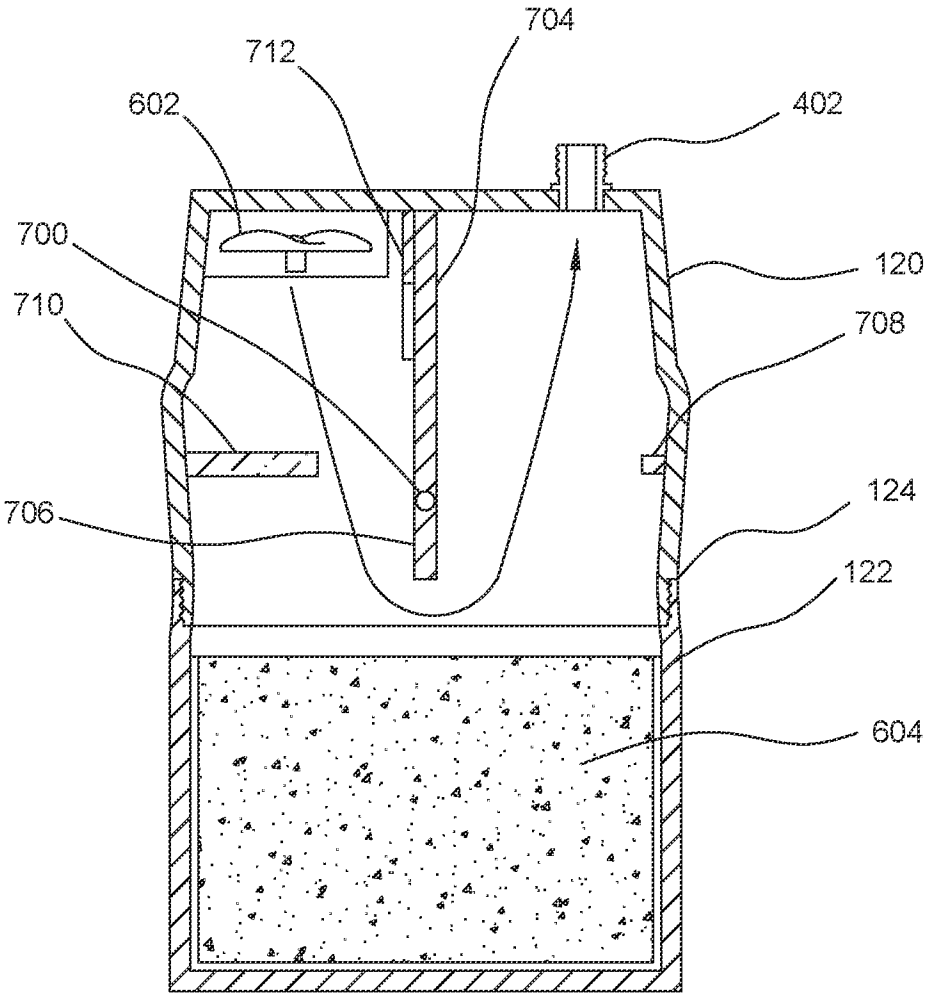
FIG. 10 is a side cross section view of a reservoir taken along plane G-G' showing the diverter valve in a second position, in accordance with some embodiments.
Figure 11:
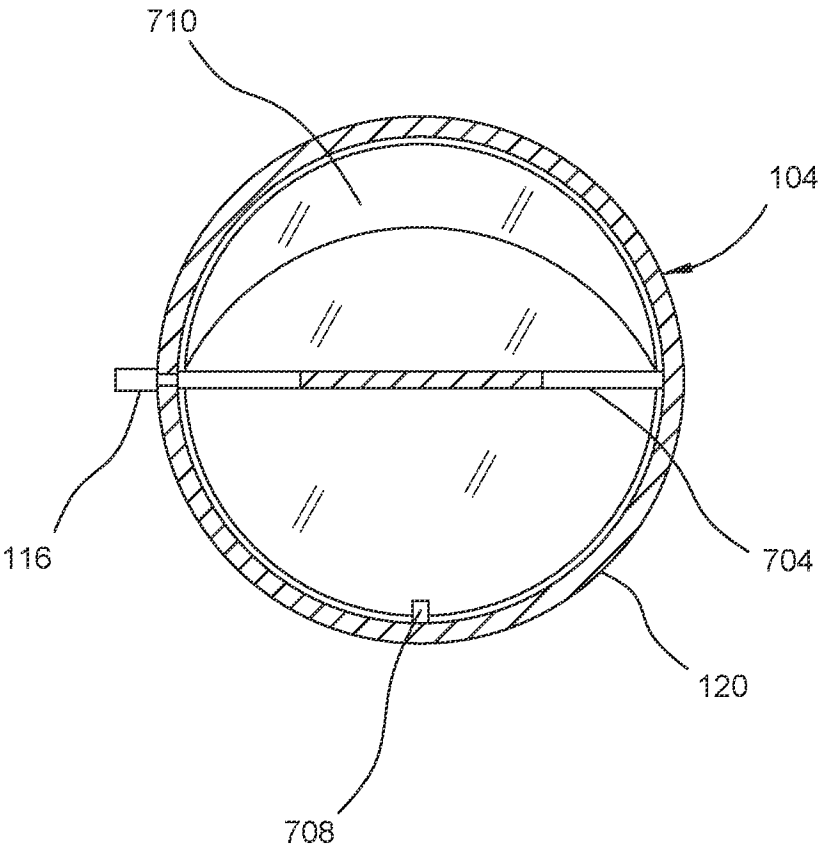
FIG. 11 is a top cross section view of a reservoir taken along plane A-A' showing the diverter valve in a second position, in accordance with some embodiments.
Figure 12:
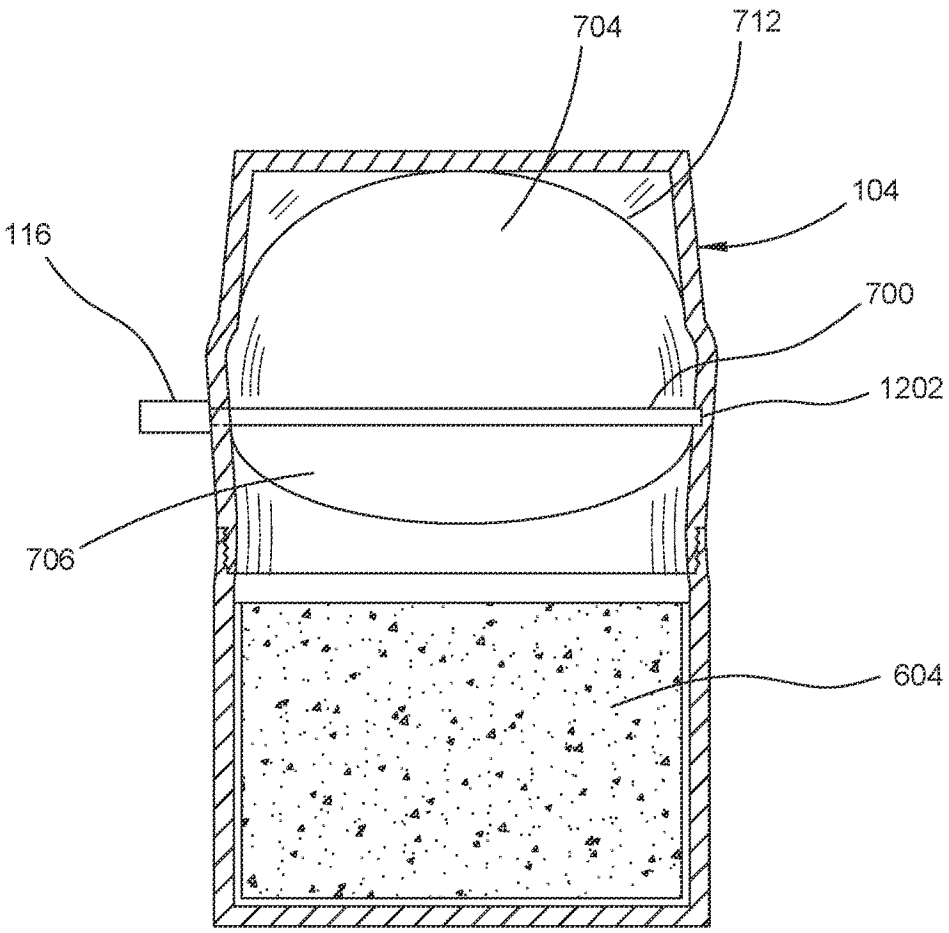
FIG. 12 is a front cross section view of a reservoir taken along plane B-B' showing the diverter valve in a first position, in accordance with some embodiments.

FIG. 7 is a side sectional view of a reservoir 104 taken along plane G-G' having a diverter valve 702, in accordance with some embodiments. The diverter valve 702 can be an addition to the reservoir 104 as shown in FIG. 6, and allows the user to selectively direct air over the chilled material 604, or through the reservoir 104 without the air being chilled by the chilled material 604. This can allow the user to conserve the chilled material and still receive a flow of air that can be cooler than the interior of the helmet. In explaining operation of the diverter valve 702, reference should also be made to FIGS. 8-12, in which FIG. 8 is a top cross section view of a reservoir 104 taken along plane A-A' showing the diverter valve in a first position. FIG. 9 is a front cross section view of a reservoir 104 taken along plane B-B' showing the diverter valve in a first position. FIG. 10 is a side cross section view of a reservoir 104 taken along plane G-G' showing the diverter valve in a second position. FIG. 11 is a top cross section view of a reservoir 104 taken along plane A-A' showing the diverter valve in a second position. FIG. 12 is a front cross section view of a reservoir 104 taken along plane B-B' showing the diverter valve in a first position.

As shown in FIGS. 7-10, the diverter valve 702 is in a horizontal position that prevents air from reaching the chilled material 604. In FIGS. 10-12 the diverter valve 702 is oriented vertically to force air over the chilled material 604 before it exits the reservoir 104. The diverter valve 702 is a generally planar member that rotates about an axis 700 that passes horizontally through the planar body of the diverter valve 702 by operation of the diverter valve control 116. The diverter valve 702 has a first portion 704 and a second portion 706 on opposite sides of the axis 700. In general, the first portion 704 is semi-circular or otherwise follows the interior sidewall of the reservoir, and extends from the axis 700 to the sidewall of the reservoir 104. In the first position the distal edge of the first portion 704 can rest on a stop feature 708 that extends from the sidewall of the reservoir 104 into the interior volume. The stop feature 708 prevents the diverter valve from rotating further once the distal edge of the first portion 704 makes contact with the stop feature 708. A shelf 710 likewise extends into the interior of the reservoir from the interior sidewall and meets the distal edge of the second portion 706 of the diverter valve 702. Thus, in the first position, the diverter valve 702 substantially meets the sidewall of the reservoir around the first distal edge of the first portion 704, and the shelf 710 around the distal edge of the second portion 706. Although there is a small gap between the first portion 704 and the interior sidewall of the reservoir, and between the second portion 706 and the shelf 710, the diverter valve 702 in the first position substantially prevents air from reaching the chilled material 604.

A median wall 712 extends from the top of the reservoir downward, and is offset, vertically, slightly from the axis 700 of the diverter valve 702. When the diverter valve 702 is moved to the second position, as shown in FIGS. 10-12, the outer edge of the first portion 704 will be stopped by, and rest against, the medial wall 712. The median wall 712 has a lower edge that follows the curve of the outer edge of the first portion 704 of the diverter valve 702. The median wall 712 extends across the interior of the reservoir, and extends down the opposite sides of the interior of the reservoir substantially to the axis 700 (i.e. more than halfway to all the way). Thus, when the diverter valve 702 is rotated to the second position, air drawn into the reservoir by the fan 602 must flow under the second portion 706 of the diverter valve 702, in proximity to the chilled material 604. And air is blocked from flowing under the median wall 712, in the path of arrow 722 in FIG. 7, when the diverter valve 702 is in the second position. The distance 714 between the axis 700 and the chilled material 604 is at least slightly greater than the distance 716 between the axis 700 and the shelf 710 at the center of the axis 700 from side to side in the horizontal direction. Likewise, the maximum length 718 of the first portion 704 must be less than the distance 720 Between the axis 700 and the top of the interior of the reservoir 104. The axis 700 can include a pin that passes through the of the reservoir to the diverter valve control knob 116 at one end, and through the diverter valve 702 in the plane of the diverter valve 702 to a relief 1202 in the opposite side of the reservoir 104. The upper portion 120 and the lower portion 122 of the reservoir can be joined by a threaded interface 124 that is below the diverter valve 702 to give the user full access to the lower portion 122 which facilitates placement and removal of the chilled material 604.

Figure 13B:
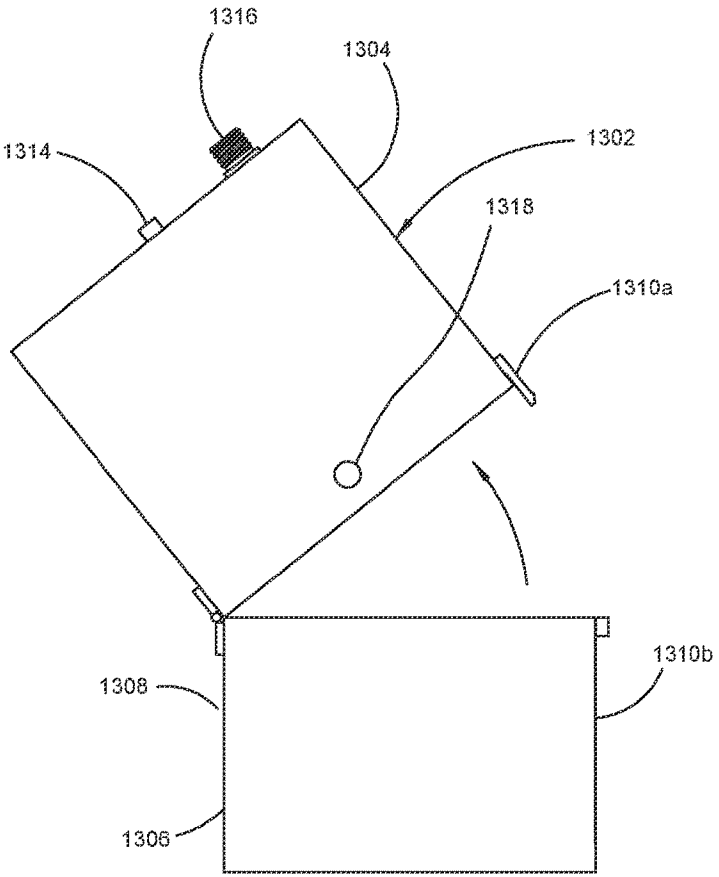
FIGS. 13A and 13B show a side view of a reservoir having a square horizontal cross section and an internal diverter valve, in a closed position and an open position, respectively, in accordance with some embodiments.
Figure 13A:
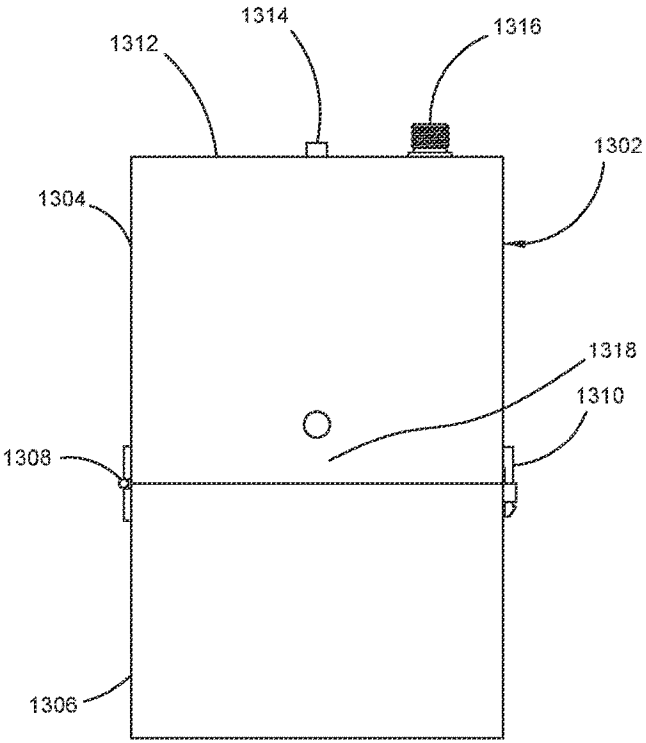
Figure 13C:
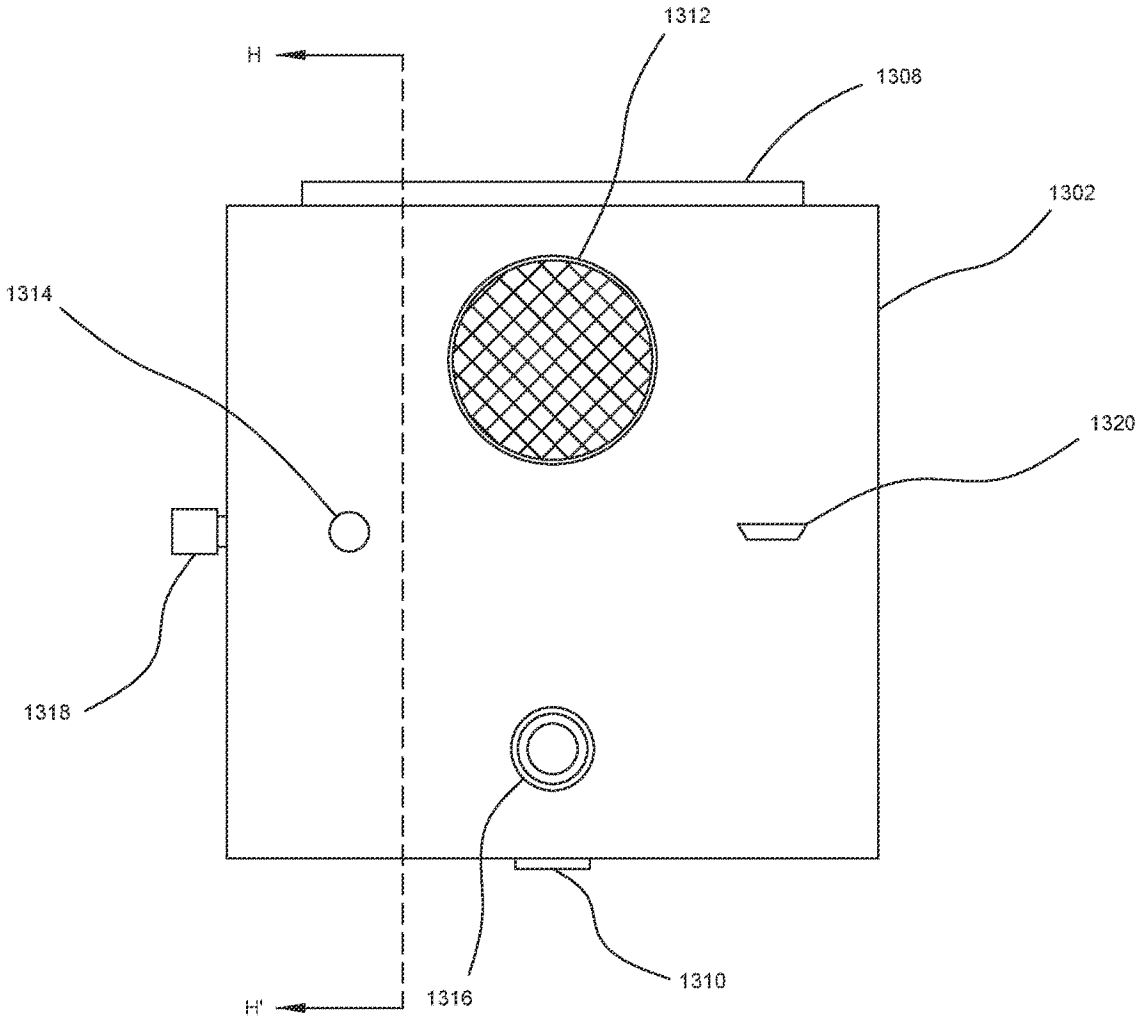
FIG. 13C is a top view of the reservoir of FIGS. 13A and 13B, in accordance with some embodiments.

FIGS. 13A and 13B show a side view of a reservoir 1302 having a square horizontal cross section and an internal diverter valve, in a closed position and an open position, respectively, and FIG. 13C is a top view of the reservoir 1302, in accordance with some embodiments. The reservoir 1302 includes an upper portion 1304 and a lower portion 1306 that are joined at the back of the reservoir 1302 by a hinge 1308. At the front of the reservoir 1302 is a latch 1310 the releasably latches the upper and lower portions 1304, 1306 together. The latch 1310 can include a latch arm 1310*a* and a latch retainer 1310*b*. The latch arm 1310*a* can be deflected to pass through the latch retainer 1310*b* and then by spring action return to its unbiased position where a catch or barb feature creates an interference with the latch retainer 1310*b*. The latch arm 1310*a* can be pressed toward the reservoir 1302 to provide clearance that allows the latch arm 1310*a* to pass under the latch retainer 1310*b* to open the reservoir. The top of the reservoir 1302 can include a fan port 1312, a speed control knob 1314, and a connecting feature 1316 that allows a connecting tube to join to the reservoir 1302. A charging port 1320, such as a USB interface, can be provided to charge the battery that powers the fan. A diverter valve control knob 1318 is provided to control operation and position of the diverter valve inside the reservoir.

Figure 14:
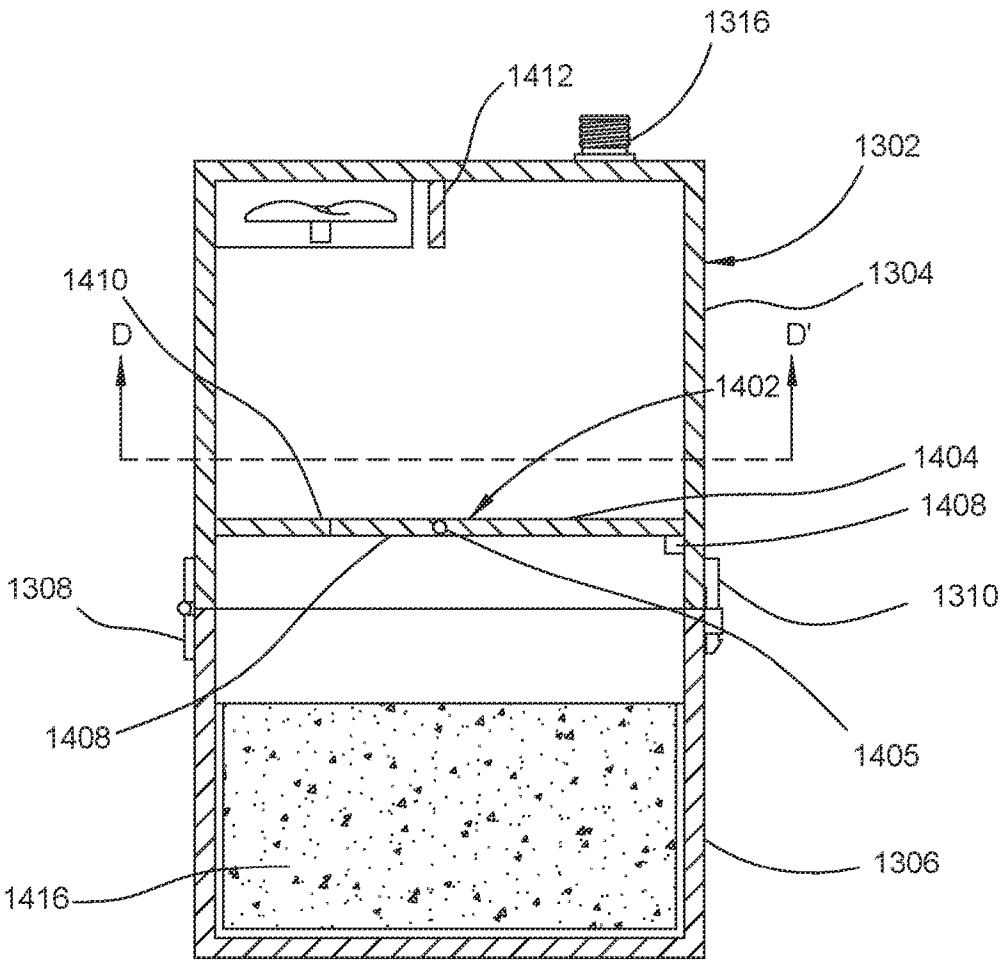
FIG. 14 is a side cross section view of a reservoir taken along plane H-H' with a diverter valve in a first position, in accordance with some embodiments.
Figure 15B:
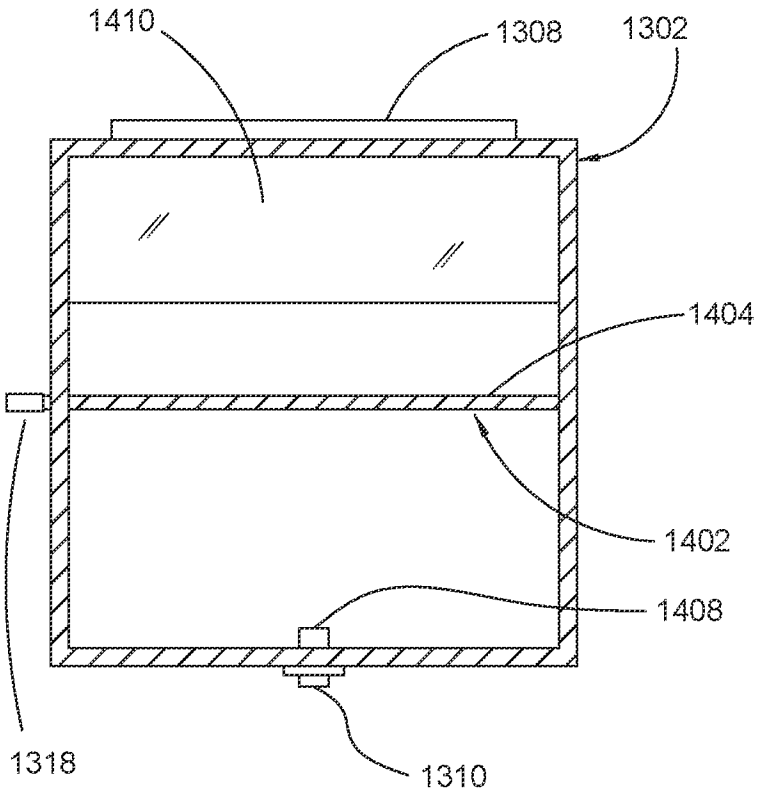
FIGS. 15A and 15B show top cross section view of the reservoir of FIG. 14 taken along plane D-D' with the diverter valve in the first position and in a second position, respectively, in accordance with some embodiments.
Figure 15A:
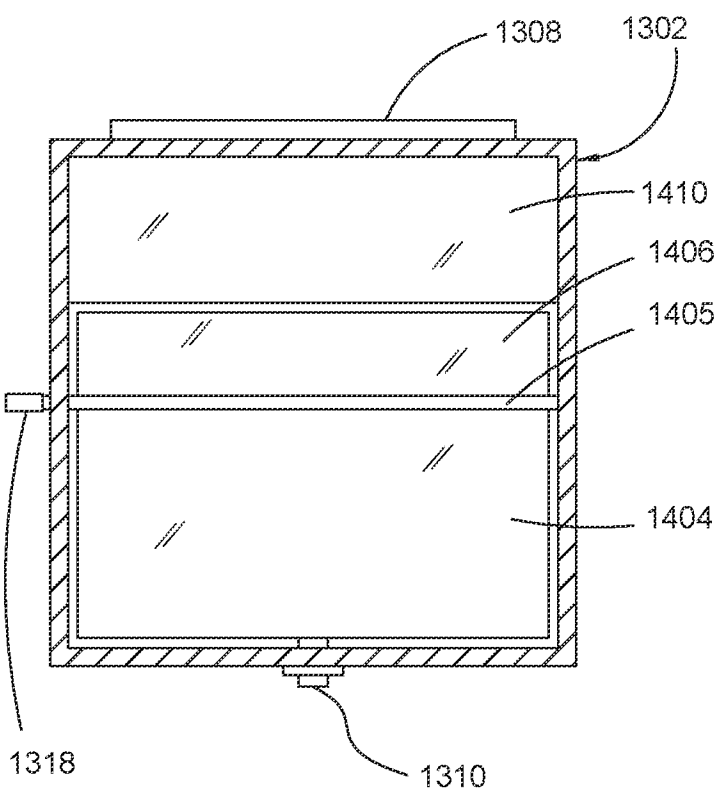

FIG. 14 is a side cross section view of a reservoir 1302 taken along plane H-H' with a diverter valve 1402 in a first position, and FIGS. 15A and 15B show top cross section view of the reservoir 1302 taken along plane D-D' with the diverter valve 1402 in the first position and in a second position, respectively, in accordance with some embodiments. The diverter valve 1402 includes a first portion 1404 and a second portion 1406 on opposite sides of an axis 1405, about which the diverter valve 1402 rotates. The first portion 1404 extends to the interior side of the front sidewall of the reservoir, while the second portion 1406 extends to meet a shelf 1410 that extends from the interior of the back sidewall. A stop feature 1408 prevents diverter valve 1402 from being rotated such that the first portion 1404 would be below the axis 1405. Thus, as shown in FIG. 15A, the diverter valve 1402 in the first position closes off the chilled material 1416 and substantially prevent air from being blown onto the chilled material 1416. In the second position as shown in FIG. 15B the first portion 1404 of the diverter valve 1402 will meet the medial wall 1412 which extends across the reservoir parallel to the axis 1405 substantially as shown in FIG. 10, and as such, air is forced to flow under the second portion 1406, and between the second portion 1406 and the chilled material.

Figure 16B:
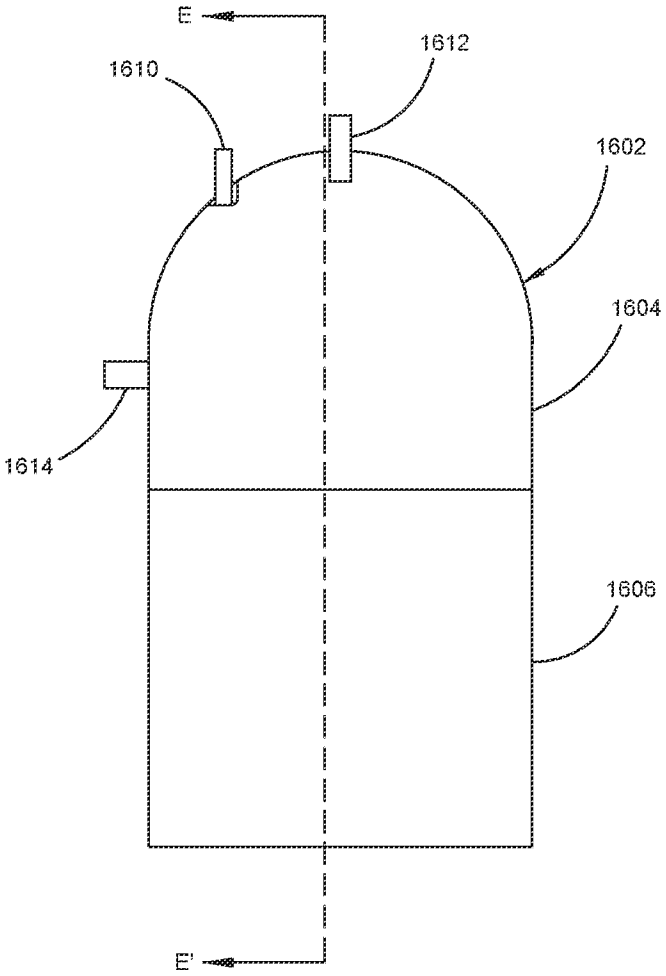
FIGS. 16A and 16B show a side view and a front view, respectively, of a reservoir having a domed top, in accordance with some embodiments.
Figure 16A:
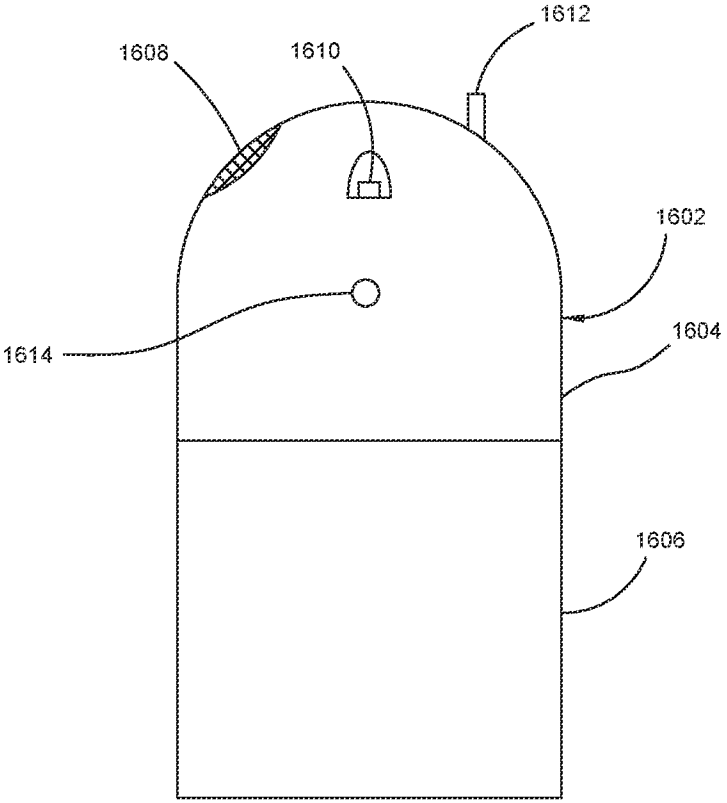
Figure 17B:
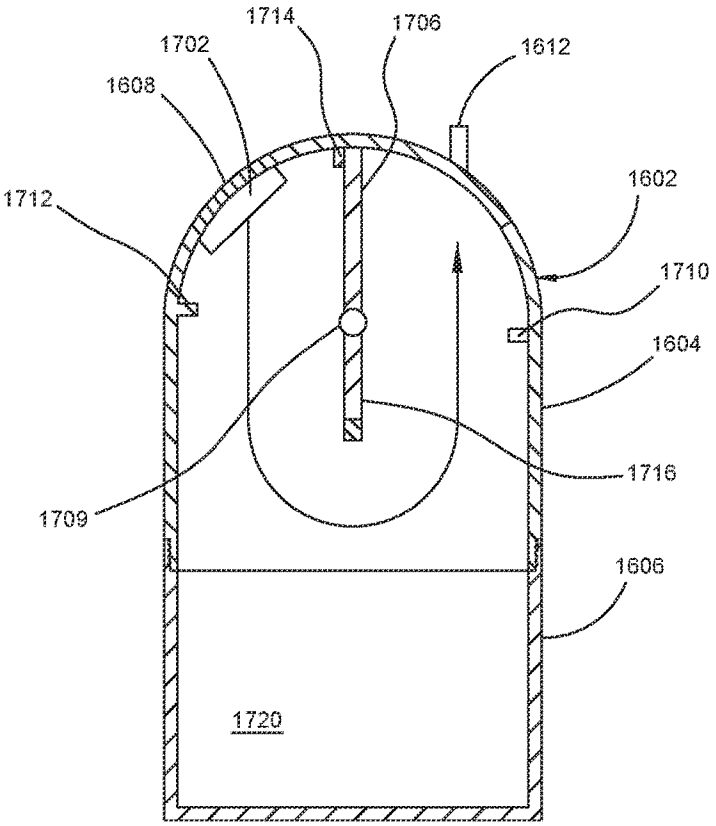
FIGS. 17A and 17B are side cross section views of a reservoir taken along plane E-E' showing a diverter valve in first and second positions, respectively, in accordance with some embodiments.
Figure 17A:
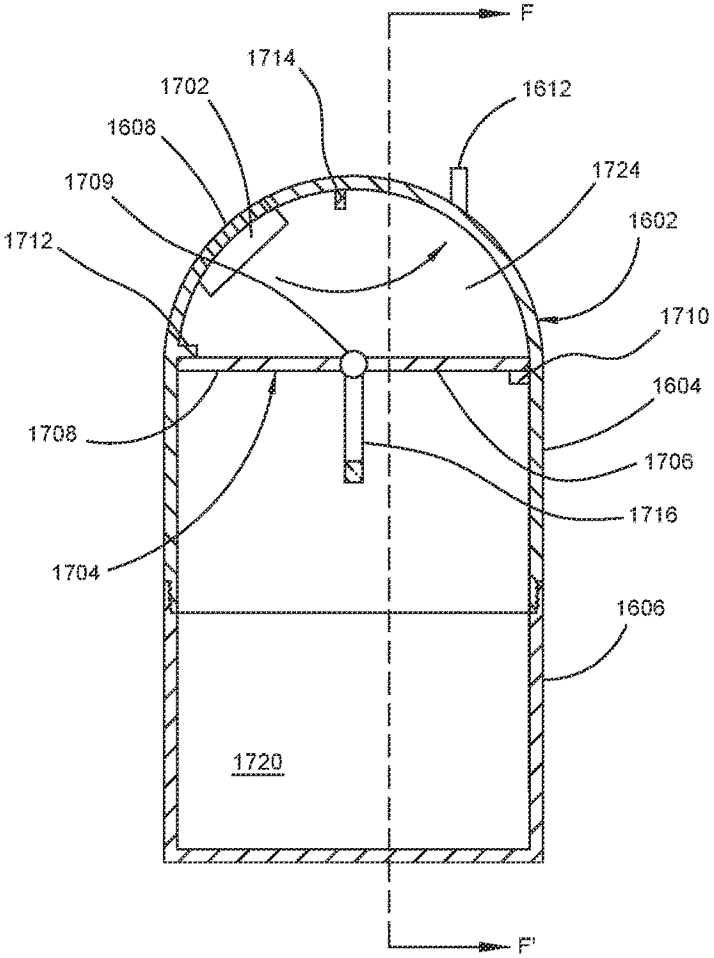
Figure 18B:
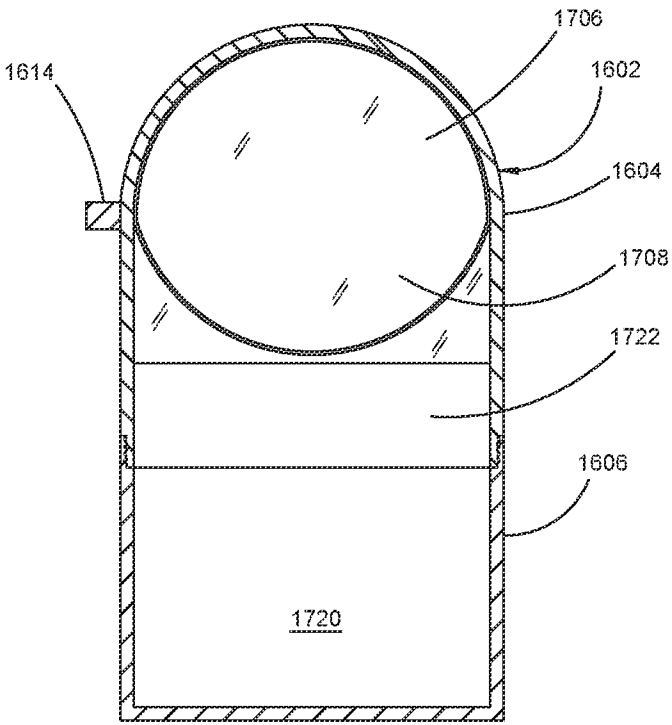
FIGS. 18A and 18B are front cross section views of a reservoir taken along plane F-F' showing a diverter valve in first and second positions, respectively, in accordance with some embodiments.
Figure 18A:
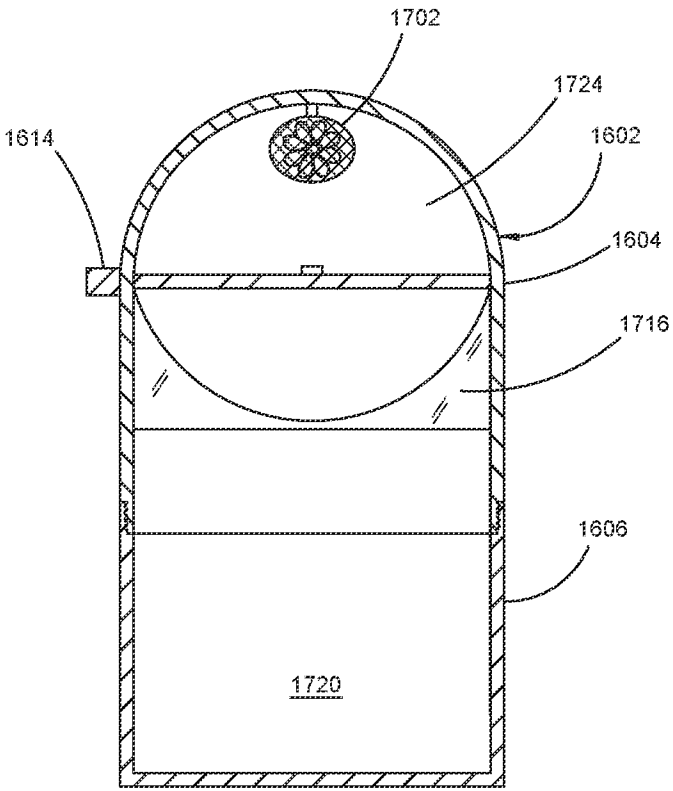

FIGS. 16A and 16B show a side view and a front view, respectively, of a reservoir 1602 having a domed top, in accordance with some embodiments FIGS. 17A and 17B are side cross section views of a reservoir 1602 taken along plane E-E' showing a diverter valve 1704 in first and second positions, respectively. FIGS. 18A and 18B are front cross section views of a reservoir 1602 taken along plane F-F' showing a diverter valve 1704 in first and second positions, respectively, in accordance with some embodiments. In FIGS. 16A and 16B the reservoir 1602 is cylindrical and has upper and lower portion 1604 and 1606, respectively, which can be coupled together, such as by a threaded engagement, to create an interior volume of the reservoir 1602. The reservoir 1602 includes a fan port 1608, a fan speed control knob 1610, and a connecting feature 1612 that extends from the top reservoir 1602 and is configured to receive an end of a connecting tube. A diverter valve control knob 1614 extends from the side of the reservoir 1602 and is coupled to the diverter valve 1704 to allow a user to rotate the diverter valve between the first and second positions.

As seen in FIGS. 17A and 18A the diverter valve 1704 extends across the interior of the reservoir 1602 and can be stopped in the first position by one or both of stop features 1710, 1712. The diverter valve 1704 has first and second portions 1706, 1708 that are substantially equal and form a planar disk that rotates about the axis 1709. A fan 1702 draws air into the reservoir 1602 which forces air out the connecting feature 1612 through space 1724. Thus, in the first position, air does not pass into the lower region 1720 where a chilled material can be disposed. In FIGS. 17B and 18B, the diverter valve 1704 is in the second position where the first portion 1706 of diverter valve 1704 meets top stop feature 1714 that extends from the top of the interior of the reservoir 1602. The domed top of the reservoir 1602 has a spherical radius that is equivalent to the cylindrical radius of the interior of the side walls, thus, the first portion 1706, having a semicircular shape with a radius slightly less than that of the interior of the reservoir 1602 follows closely along the interior of the domed top as well to substantially block the flow of air and force air under the second portion 1708 of the diverter valve 1704 through space 1722. To enhance the amount of air contact with chilled material in the bottom of the reservoir 1602, a median wall 1716 can extend across the interior of the reservoir 1602 directly under and parallel to the axis 1709. The top of the medial wall 1716 is shaped with a semicircular arc that substantially matches the outer edge of the second portion 1708 of the diverter valve 1704 to block air from passing around the second portion 1708 when the diverter valve is in the second position.

Thus, in general, a reservoir has been disclosed in several substantially equivalent embodiments that use variously shaped reservoirs. The reservoir includes two separable portions, which can be major body portions or a lid and a body portion. The reservoir has an interior volume in which chilled material is placed. Further, the reservoir has a fan that draws or pushes air into the interior volume of the reservoir, and, eventually, out through the connecting feature. The fan speed and on/off operation can be controlled by a fan speed control knob. Thus, when the user wishes to have cool air blown into their helmet, they simply turn on the fan. In some embodiments, the reservoir can have a diverter valve that in a first position diverts air from the fan away from the chilled material. This allows the user to receive ambient air into the helmet, which can provide some comfort, and conserver the temperature of the chilled material. But if the user wants chilled air, they simply adjust the diverter valve to the second position which forces air over the chilled material before it exits the reservoir through the connecting feature.

The claims appended hereto are meant to cover all modifications and changes within the scope and spirit of the present invention.

What is claimed is:

1. A motorcycle helmet cooling system, comprising:

a portable reservoir unit having:

an interior compartment defining an interior volume and having a floor and a surrounding wall around, and extending upward from the floor to an opening;

a fan adjacent a fan opening;

a connecting feature extending from an exterior of the portable reservoir and having a bore therethrough that is fluidly connected to the interior compartment;

wherein the fan is configured to draw air into the interior compartment and out through the bore of the connecting feature, and wherein the interior compartment has a lower portion proximate to the floor that is configured to hold a chilled medium;

a diverter valve disposed inside the reservoir that is configured to be moved between a first position and a second position, wherein in the first position the diverter valve closes off the lower portion of the interior compartment, and in the second position forces airflow from the fan to pass under a portion of the diverter valve adjacent the lower portion of the interior compartment;

a helmet having an interior liner comprising a channel formed in the liner and a connecting feature on an exterior of the helmet having a bore therethrough that is fluidly connected to the channel in the liner; and a connecting tube having a first end coupled to the connecting feature of the portable reservoir and a second end coupled to the connecting feature of the helmet.

2. The motorcycle helmet cooling system of claim 1, wherein the portable reservoir includes a fan speed selector switch that is configured to control a speed of the fan.

3. The motorcycle helmet cooling system of claim 1, further comprising a rechargeable battery coupled to the fan and which provides power to the fan, and a charging port on the portable reservoir that is operably coupled to the rechargeable battery.

4. The motorcycle helmet cooling system of claim 1, wherein the diverter valve is mounted on an axis that passes through the interior compartment of the portable reservoir and extends through a sidewall of the reservoir to a valve control knob on the exterior of the portable reservoir.

5. The motorcycle helmet cooling system of claim 4, further comprising a median wall disposed in the internal compartment of the portable reservoir that extends from a top of the internal compartment, and which has a lower edge that is shaped in correspondence with an outer edge of the diverter valve.

6. A motor cycle helmet cooling system, comprising:

a portable reservoir unit having an upper portion and a lower portion, the upper portion and the lower portion each being configured to assemble together and define an interior compartment within the upper and lower portions when assembled together, the portable reservoir including:

a fan adjacent a fan opening through a wall of the portable reservoir;

a connecting feature extending from an exterior of the portable reservoir and having a bore therethrough that is fluidly connected to the interior compartment;

wherein the fan is configured to draw air into the interior compartment and out through the bore of the connecting feature, and wherein the interior compartment has a lower portion that is configured to hold a chilled medium;

a diverter valve mounted in the interior compartment that is movable between a first position and second position, wherein in the first position the diverter valve closes off the lower portion of the interior compartment and provides a barrier between the lower portion of the interior compartment and the fan, and wherein in the second position the diverter valve forces air from the fan to pass under the diverter valve adjacent the lower portion of the interior compartment before exiting through the connecting feature;

a helmet having an interior liner comprising a channel formed in the liner and a connecting feature on an exterior of the helmet having a bore therethrough that is fluidly connected to the channel in the liner; and a connecting tube having a first end coupled to the connecting feature of the portable reservoir and a second end coupled to the connecting feature of the helmet.

7. The helmet cooling system of claim 6, further comprising:

the diverter valve having a planar member having a transverse axis that extends horizontally from one side of the portable reservoir through the internal compartment to an opposite side of the portable reservoir;

the planar member having a first portion that extends from the axis to an outer edge, wherein when the diverter valve is in the first position, the outer edge of the first portion is adjacent an inner wall of the portable reservoir, and rests against a stop feature on the inner wall;

a median wall that extend down from a top of the interior compartment, and which has a lower edge that is shaped in correspondence with the outer edge of the first portion of the diverter valve; and a shelf that extends horizontally into the interior compartment to meet an outer edge of a second portion of the diverter valve that is opposite the first portion of the diverter valve relative to the axis, and wherein the second portion of the diverter valve extends a shorter distance from the axis than the first portion of the diverter valve extends from the axis.

8. The motorcycle helmet cooling system of claim 7, further comprising a diverter valve control on an outside of the portable reservoir along the axis.

9. The motorcycle helmet cooling system of claim 6, wherein the portable reservoir includes a fan speed selector switch that is configured to control a speed of the fan.

10. The motorcycle helmet cooling system of claim 6, further comprising a rechargeable battery coupled to the fan and which provides power to the fan, and a charging port on the portable reservoir that is operably coupled to the rechargeable battery.

11. The motorcycle helmet cooling system of claim 6, wherein a lower edge of the upper portion of the portable reservoir is threaded, and a top edge of the lower portion of the portable reservoir is correspondingly threaded to engage the threads of the upper portion of the portable reservoir, thereby allowing the upper portion and the lower portion to be assembled together.

12. The motorcycle helmet cooling system of claim 6, wherein the upper portion and the lower portion of the portable reservoir are joined together by a hinge.

13. The motorcycle helmet cooling system of claim 12, further comprising a latch disposed on the portable reservoir opposite the hinge that is configured to releasably latch the upper and lower portions of the portable reservoir together.

* * * * *